US009457486B2

(12) United States Patent
Coresh

(10) Patent No.: US 9,457,486 B2
(45) Date of Patent: Oct. 4, 2016

(54) SHAVING CARTRIDGE WITH INDIVIDUAL BLADE GUARDS

(71) Applicant: Alon Leon Coresh, Marina del Rey, CA (US)

(72) Inventor: Alon Leon Coresh, Marina del Rey, CA (US)

(73) Assignee: Rolling Razor, Inc, Marina del Rey, CA (US)

( * ) Notice: Subject to any disclaimer, the term of this patent is extended or adjusted under 35 U.S.C. 154(b) by 416 days.

(21) Appl. No.: 13/801,883

(22) Filed: Mar. 13, 2013

(65) Prior Publication Data

US 2014/0259677 A1 Sep. 18, 2014

(51) Int. Cl.
*B26B 21/40* (2006.01)

(52) U.S. Cl.
CPC ..... *B26B 21/4031* (2013.01); *B26B 21/4018* (2013.01)

(58) Field of Classification Search
CPC ..... B26B 21/4018; B26B 21/4031
USPC ..... 30/4–60.5, 65, 70, 77, 81
See application file for complete search history.

(56) References Cited

U.S. PATENT DOCUMENTS

| | | | | |
|---|---|---|---|---|
| 3,138,865 | A | 6/1964 | Meyer | |
| 4,170,821 | A | 10/1979 | Booth | |
| 4,516,320 | A | 5/1985 | Peleckis | |
| 4,932,122 | A * | 6/1990 | Shurland et al. | 30/50 |
| 5,038,472 | A | 8/1991 | Iderosa | |
| 5,152,064 | A | 10/1992 | Johnston | |
| 5,426,853 | A | 6/1995 | McNinch | |
| 5,711,076 | A | 1/1998 | Yin | |
| 5,781,997 | A | 7/1998 | Ferraro et al. | |
| 6,161,288 | A | 12/2000 | Andrews | |
| 6,212,777 | B1 * | 4/2001 | Gilder et al. | 30/50 |
| 6,243,951 | B1 | 6/2001 | Oldroyd | |
| 6,311,400 | B1 | 11/2001 | Hawes et al. | |
| 6,397,473 | B1 | 6/2002 | Clark | |
| 6,434,828 | B1 | 8/2002 | Andrews | |
| 6,550,141 | B1 * | 4/2003 | Rivers | B26B 21/4006 30/346.57 |
| 6,880,253 | B1 | 4/2005 | Gyllerstrom | |
| 7,086,160 | B2 | 8/2006 | Coffin et al. | |
| 7,111,401 | B2 * | 9/2006 | Richard | B26B 21/4018 30/346.5 |
| 7,131,203 | B2 | 11/2006 | Wain | |

(Continued)

FOREIGN PATENT DOCUMENTS

| | | |
|---|---|---|
| CN | 1212647 | 3/1999 |
| CN | 1469797 | 1/2004 |

(Continued)

OTHER PUBLICATIONS

Examination Report Dated Feb. 9, 2012 From the Intellectual Property Office of New Zealand Re. Application No. 591266.

(Continued)

*Primary Examiner* — Sean Michalski
*Assistant Examiner* — Liang Dong
(74) *Attorney, Agent, or Firm* — Thomas Coester Intellectual Property

(57) ABSTRACT

A shaving razor having integrally formed blade guards. A generally monolithic body is formed from a suitable material such as thermoplastic to define blade channels for a plurality of blades, 1 blade retained in each channel the cutting edges of which define a cutting plane. A plurality of blade guards is formed as part of the body such that the shaving plane passes through the blade guards with one blade guard forward of each blade in the cutting direction. Other embodiments are also described and claimed.

8 Claims, 3 Drawing Sheets

(56) References Cited

U.S. PATENT DOCUMENTS

| | | | | |
|---|---|---|---|---|
| 7,210,229 | B2 * | 5/2007 | Coffin | B26B 21/4031 30/346.57 |
| 7,681,314 | B2 * | 3/2010 | Follo | 30/34.2 |
| 7,721,446 | B2 | 5/2010 | Royle | |
| 8,136,249 | B2 | 3/2012 | Shiba | |
| 2004/0181949 | A1 | 9/2004 | Coffin et al. | |
| 2005/0188539 | A1 | 9/2005 | Prudden et al. | |
| 2005/0198843 | A1 | 9/2005 | Royle | |
| 2006/0064875 | A1 | 3/2006 | Follo et al. | |
| 2006/0080839 | A1 | 4/2006 | Hesketh | |
| 2006/0143925 | A1 | 7/2006 | Johnson et al. | |
| 2006/0196054 | A1 | 9/2006 | Luxton | |
| 2008/0196251 | A1 | 8/2008 | Royle | |
| 2009/0288299 | A1 | 11/2009 | Denkert | |
| 2011/0016724 | A1 | 1/2011 | Murgida | |
| 2011/0192031 | A1 | 8/2011 | Coresh | |
| 2012/0030948 | A1 * | 2/2012 | Walker et al. | 30/50 |
| 2012/0151772 | A1 | 6/2012 | Moon et al. | |
| 2012/0317818 | A1 * | 12/2012 | Oglesby | B26B 21/4018 30/77 |
| 2012/0324733 | A1 | 12/2012 | Coresh | |
| 2013/0000127 | A1 | 1/2013 | Coresh | |

FOREIGN PATENT DOCUMENTS

| | | |
|---|---|---|
| EP | 0020816 | 1/1981 |
| EP | 1046472 | 10/2000 |
| EP | 1674220 | 6/2006 |
| FR | 2433396 | 3/1980 |
| GB | 2268434 | 1/1994 |
| GB | 2411141 | 8/2005 |
| GB | 2466139 | 6/2010 |
| WO | WO-9320983 | 10/1993 |
| WO | WO-9504637 | 2/1995 |
| WO | WO-9726119 | 6/1997 |
| WO | WO-9725189 | 7/1997 |
| WO | WO-0232632 | 5/2002 |
| WO | WO-2004/087382 | 10/2004 |
| WO | WO-2005/090020 | 9/2005 |
| WO | WO-2006/036591 | 4/2006 |
| WO | WO-2010/010517 | 1/2010 |
| WO | WO 2011/027962 | 3/2011 |

OTHER PUBLICATIONS

Search Report and Written Opinion Dated Apr. 18, 2012 from the Intellectual Property Office of Singapore issued by the Austrailian Patent Office on Mar. 12, 2012 re Application No. 201100416-5.

Communication Pursuant to Article 94(3) EPC dated May 30 2012 From the European Patent Office re: Application No. 09786662.8, (May 30, 2012).

Patents Act 1977: Combined Search and Examination Report Under Sections 17 and 18(3) Dated Nov. 18, 2008 from the UK (United Kingdom) Intellectual Property Office Re: Application No. GB0813364.7, (Nov. 18, 2008).

Examination Report Dated Nov. 27, 2012 from the Eurasian Patent Organization re Application No. 201100263 and its translation into English.

Examination Report Dated Jan. 31, 2013 from the Intellectual Property Office of New Zealand re Application No. 591266.

Search and Examination Report Dated Dec. 21, 2012 from the Intellectual Property Office of Singapore re: 201100416-5.

Coresh, Leon A., International Search Report mailed Apr. 20, 2010, PCT Appln. No. PCT/IB2009/053169 filed Jul. 22, 2009, 7 pages.

Coresh, Leon A., International Preliminary Report on Patentability (Written Opinion) mailed Jan. 25, 2011 PCT Appln. No. PCT/IB2009/053169 filed Jul. 22, 2009, 8 pages.

Leon, A. C., Communicaiton Pursuant to Rules 161(1) and 162 EPC Dated May 17, 2011 From the European Patent Office Re. Application No. 09786662.8.

Leon, A. C., International Preliminary Report on Patentability Dated Feb. 3, 2011 From the International Bureau of WIPO Re. Application No. PCT/IB/2009/053169.

Non-Final Office Action in U.S. Appl. No. 13/173,911 mailed Sep. 22, 2014. 16 pages.

Final Office Action in U.S. Appl. No. 13/173,911 dated Mar. 31, 2015. 16 pages.

Search Report in European Patent Application No. 12803906.2 mailed Jan. 22, 2016. 7 pages.

* cited by examiner

SHAVING CARTRIDGE WITH INDIVIDUAL BLADE GUARDS

BACKGROUND

1. Field

Embodiments of the invention relate to shaving razors. More specifically, embodiments of the invention relate to a shaving razor having integrally formed blade guards ahead of the cutting edge of each blade.

2. Background

Various shaving razors in numerous forms have existed for many years. Recent trends in shaving razors include an increasing number of closely spaced blades with a very shallow angle relative to the shaving plane. That is the blade forms a very small acute angle with the shaving plane. While the tight spacing of the blades has traditionally been deemed necessary to avoid nicks and cuts during saving, it also leads to a cartridge being clogged with shaving cream and detached stubble reducing the effectiveness of the razor cartridge as well as its useful life.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
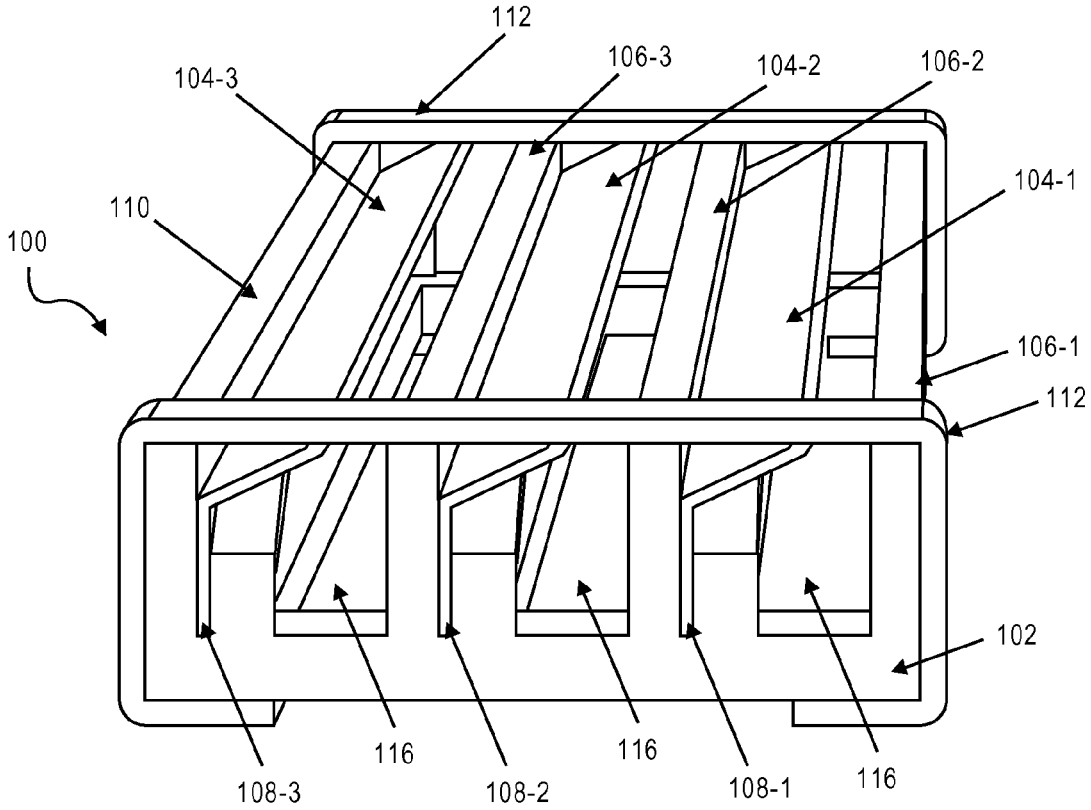
FIG. 1 is a diagram of a perspective view of a cartridge of one embodiment of the invention.

FIG. 1 is a diagram of a perspective view of a cartridge of one embodiment of the invention. Cartridge 100 includes 3 blades 104-1, 104-2 and 104-3 (generically blade 104) leading blade 104-1 as followed by blade 104-2 which in turn is followed by blade 104-3. As used herein "leading" refers to the front item in the direction of shave. A "following" or "trailing" item is further from the leading edge relative to the direction of shave. Blades 104 collectively define a shaving plane in which a cutting edge of all blades resides. Although three blades are depicted, n blades are possible where n is an integer greater than 1.

Cartridge 100 also includes a molded body 102 that retains the blades 104 such that their cutting edge resides in the shaving plane. Body 102 may be monolithically injection molded from a suitable thermoplastic. Body 102 defines a plurality of blade channels 108-1, 108-2, and 108-3 (generically blade channel 108) in which blades 104-1, 104-2, and 104-3 reside respectively. The blades 104 may be adhered within the respective blade channel 108. Such adhesion may be affected by an adhesive or, for example, heat welding. Integrally formed as part of the body 102 are a plurality of blade guards 106-1, 106-2, and 106-3 (generically blade guard 106) each forward of the cutting edge of blades 104-1, 104-2, and 104-3 respectively. These blade guards are elevated above; that is, the shaving plane passes through the blade guards. The leading surface of blade guards 106-2 and 106-3 form blade-supporting surfaces for blades 104-1 and 104-2 respectively. The supporting surface for trailing blade 104-3 is provided by back panel 110, which also forms the trailing edge of the cartridge. The blade guards 106 reduce the risk of nicks and cuts while permitting greater blade separation such that shaving refuse passes more easily through the cartridge and out of voids 116 on the backside thereof. The greater blade separation reduces the pulling and tugging on individual hairs as the separation makes it unlikely that more than one blade will engage any particular hair.

Cartridge 100 also includes a pair of metallic retention members 112 which ensure that the blades cannot be deformed to extend above the level of the blade guards. Retention members 112 prevent the blades 104 from leaving the blade channels 108 even if the adhesion in the channels fails. This provides further insurance against nicks and cuts resulting from possible deformation of one or more of the blades 104 during use.

Figure 2:
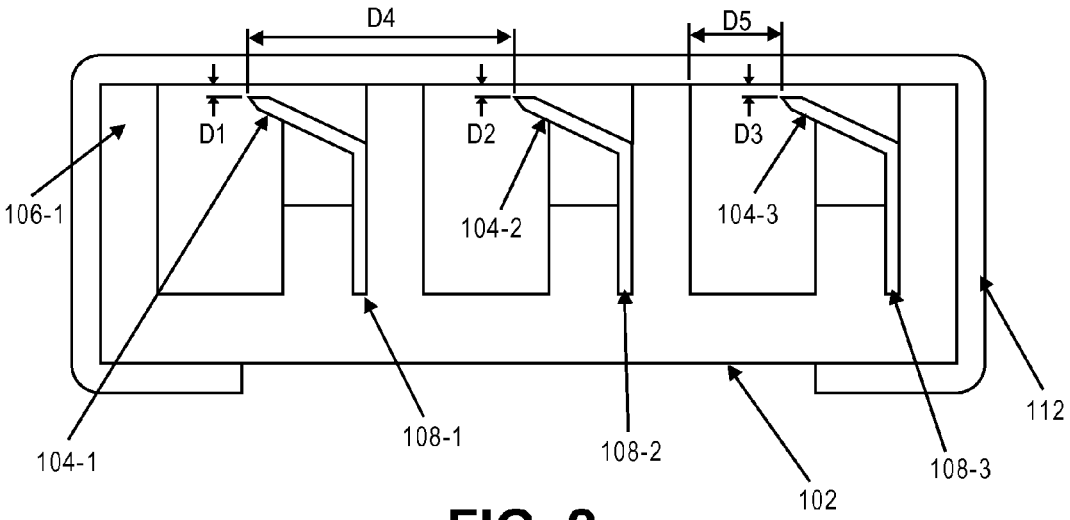
FIG. 2 is a side schematic view of a cartridge of one embodiment of the invention.

FIG. 2 shows a side schematic view of a cartridge of one embodiment of the invention. In this view, the elevation of the shaving plane relative to the blade guards 106 is more clearly depicted. Blade guard 1 06-1 extends a distance D1 above the shaving plane. Blade guard 106-2 extends a distance D2 above the shaving plane. Finally, blade guard 106-3 extends a distance D3 above the shaving plane. Distances D1, D2, and D3 may be the same, or they may be different. In the event that they are different, in one embodiment, the distances have substantially linear decrease from D1 to D3, which results in each successive blade providing a closer shave. Because these distances can be independently controlled it is possible that e.g. D1=D3>D2. For example D1 and D3 may be 0.02 mm and D2 may be 0.00 mm. In such an embodiment the cutting edge of all blades do not lie in a single plane. Other selections and arrangement of these distances are also possible.

Generally, the distances D1-D3 can be selected to provide different closeness's of shave for different market segments. As D decreases the shave's closeness increases. However, a larger D is more desirable for sensitive skin. Generally, the distance D will be selected in the range of 0.00-0.10 mm. For normal skin a D of approximately 0.00 mm is selected. For sensitive skin a D of 0.03 is selected. For very sensitive skin a D greater than 0.06 mm will be selected. For extremely sensitive skin a D of approximately 0.10 is selected. In an example embodiment for regular skin with differing Ds: D1 may be 0.02 mm, D2 may be 0.01 mm and D3 may be 0.00 mm. A similar pattern can be applied to other skin types. FIG. 2 also shows a distance D4 between adjacent blades in the cartridge. This distance D4 will generally be in the range of 2.5-4.5 mm. In one embodiment D4 is approximately 3.85 mm. This space between blades as well as the space D5 between the trailing edge of the blade support and the cutting edge of the blade provides for efficient passage of shaving refuse, e.g., stubble and shaving cream. The distance D5 is expected to be in the range of 0.5-1.0 mm. In one embodiment D5 is 0.74 mm.

Figure 3:
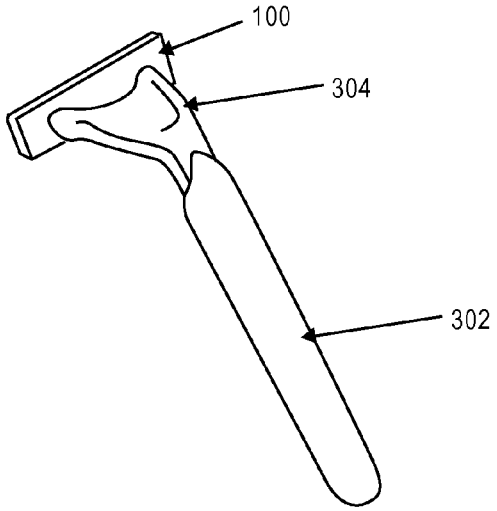
FIG. 3 is a schematic view a shaving razor of one embodiment of the invention.

FIG. 3 shows a shaving razor of one embodiment of the invention. Cartridge 100 may attach to a handle 302 via coupling member 304. Various spring-loaded coupling numbers are known in the art and would be suitable for coupling cartridge 100 to handle 304. In some embodiments the handle 304 may be molded with the body from the same thermo plastic providing a monolithic disposable unit.

Figure 4:
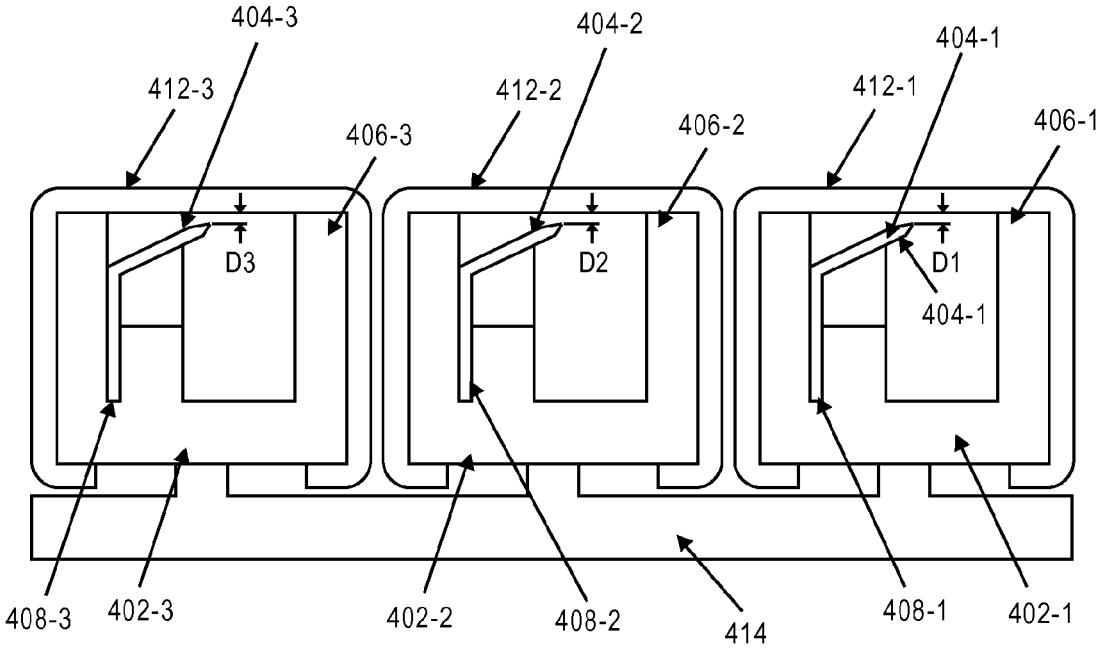
FIG. 4 depicts a side view of an alternative embodiment of the invention.

FIG. 4 depicts a side view of an alternative embodiment of the invention. A substrate 414 is integrally molded with a plurality of sub cartridges 402-1, 402-2, and 402-3 (generically sub cartridge 402) that each respectively define a blade channel 408-1, 408-2, and 408-3. Each blade channel has disposed therein a respective blade 404-1, 404-2, and 404-3, which may be coupled therein in a manner similar to that described above in connection with FIG. 1. Each sub cartridge 402 also includes integrally formed therewith a blade guard 406 (406-1, 406-2, and 406-3) which reside a distance D5 in front of the cutting edge of the respective blade and a distance D1, D2, and D3 respectively above the cutting plane defined by the blades 404. This embodiment also includes retention bands 412 (412-1, 412-2, 412-3) a pair for each sub cartridge 402. Additionally, while three sub cartridges 402 are shown, it is envisioned that n sub cartridges were n is an integer greater than 1 are within the scope and contemplation of the invention. This embodiment also has the features of greater blade spacing while reducing the risk of nicks and cuts and providing backside voids through which shaving refuse can be expelled. It is expected that these embodiments will provide a more consistent quality shave a longer lasting razor than existing techniques.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A cartridge for a shaving razor comprising:

a first blade having a first cutting edge residing in a cutting plane;

a molded plastic body retaining the first blade, the body having a first blade-supporting surface and a first blade guard formed to be in advance of the cutting edge in a shaving direction, the first blade guard extending a distance $D_1$ above the cutting plane, wherein the first supporting surface defines part of a first blade channel in the body;

a second blade also having a second cutting edge residing in the cutting plane and wherein the body further has a second blade-supporting surface and a second blade guard formed between the first and the second blade-supporting surfaces, the second blade guard extending a distance $D_2$ above the cutting plane, wherein the second supporting surface defines part of a second blade channel in the body; and a third blade also having a cutting edge residing in the cutting plane and wherein the body further has a third blade-supporting surface and a third blade guard formed between the second and the third blade-supporting surfaces, the third blade guard extending a distance $D_3$ above the cutting plane, wherein distances $D_1$ to $D_3$ decrease linearly, and wherein both the third blade guard and the third blade-supporting surface are unitarily formed as a part of the body, wherein the third supporting surface defines part of a third blade channel in the body;

a first open space located between the first cutting edge and the first guard;

a second open space located between the second cutting edge and the second guard;

a third open space located between the third cutting edge and the third guard.

2. The cartridge of claim 1 further comprising:

a plurality of bands to retain the first blade and the second blade in respective blade channels.

3. The cartridge of claim 1 wherein the first blade and the second blade are coupled to the first blade-supporting surface and the second blade-supporting surface, respectively.

4. The cartridge of claim 1 wherein the first and second blades are adjacent to each other in the cartridge and define a space there between in the cutting plane of greater than 0.5 millimeters.

5. The cartridge of claim 1 further comprising a coupling member to couple the cartridge to a handle.

6. The cartridge of claim 1 wherein a single structure of the body provides both the first blade-supporting surface and the second blade guard; and wherein another single structure of the body provides both the second blade-supporting surface and the third blade guard.

7. The cartridge of claim 1 wherein a single structure of the body provides both the first blade-supporting surface and the second blade guard.

8. The apparatus of claim 1 where in the first blade is a forward most blade in a cutting direction of all blades in the apparatus.

* * * * *